United States Patent [19]

Petersen

[11] Patent Number: 4,502,531

[45] Date of Patent: Mar. 5, 1985

[54] HIGH-PRESSURE VESSEL FURNACE

[75] Inventor: Peter Petersen, Murray Hill, N.J.

[73] Assignee: Allied Corporation, Morris Township, Morris County, N.J.

[21] Appl. No.: 470,739

[22] Filed: Feb. 28, 1983

[51] Int. Cl.[3] ..... F28F 7/00

[52] U.S. Cl. ..... 165/76; 165/30; 165/61; 165/64; 165/80 D; 165/80 R; 165/136; 165/169; 219/424; 219/432

[58] Field of Search ..... 165/30, 26, 27, 80 D, 165/80 E, 80 R, 61, 64, 136, 76, 169; 219/421, 424, 432

[56] References Cited

U.S. PATENT DOCUMENTS

| | | | |
|---|---|---|---|
| 1,623,209 | 4/1927 | Schuster | 219/424 X |
| 2,324,533 | 7/1943 | Pearson et al. | 165/80 E |
| 2,767,300 | 10/1956 | Verter | 219/424 X |
| 3,143,167 | 8/1964 | Vieth | 165/27 |
| 3,155,157 | 11/1964 | Anderson et al. | 165/30 |
| 3,790,749 | 2/1974 | Lee | 219/424 |
| 4,196,772 | 4/1980 | Adamski et al. | 165/169 X |
| 4,231,425 | 11/1980 | Engstrom | 165/169 X |
| 4,261,415 | 4/1981 | Smith, Jr. | 165/169 X |
| 4,269,265 | 5/1981 | Meyer et al. | 165/109 T |
| 4,379,390 | 4/1983 | Bottum | 165/169 X |
| 4,446,360 | 5/1984 | Gellert | 219/424 X |

OTHER PUBLICATIONS

Catalog Sheets; Parr Instrument Company, Moline, Illinois, Catalog 4500, 3/82, pp. 1–2, 42–43.

Catalog Sheets; (PPI) Pressure Products Industries Division; The Duriron Company Inc., Warminster, PA, 7/79, p. 4.

Catalog Sheets; Superpressure Equipment, Nov. 1981, p. 28.

Catalog Sheets; High Pressure Equipment Co., Erie, PA, Catalog 90A, pp. 40–41.

*Primary Examiner*—Sheldon J. Richter
*Assistant Examiner*—Randolph A. Smith
*Attorney, Agent, or Firm*—Paul Yee; Ernest D. Buff; Gerhard H. Fuchs

[57] ABSTRACT

The invention provides an apparatus and method for heating a vessel having a vessel bottom and at least one vessel side wall. The invention includes a furnace housing which is adapted to contain the vessel and which has a housing bottom and at least one housing side wall. A heater mechanism, located at the housing bottom and at the housing side wall, heats the vessel and is adapted to contact selected portions of the vessel bottom and vessel side wall. Thermal insulation is disposed about the housing for reducing heat loss therefrom, and an extendable temperature sensor is adapted to contact the vessel and monitor the temperature thereof.

12 Claims, 4 Drawing Figures

HIGH-PRESSURE VESSEL FURNACE

BACKGROUND OF THE INVENTION

1. Field of the Invention

The invention relates to furnace heaters. More particularly, the invention relates to a furnace for heating high pressure vessels or reactors.

2. Description of the Prior Art

It is often desirable to subject substances to high pressures over 15,000 psi and high temperatures of up to about 600° C. Typically, the substance is placed into a pressure vessel type container capable of withstanding such pressure and the vessel is then heated to the desired temperature. Conventional high-pressure reactors have employed internal heaters disposed directly within the container volume and have employed integral jacket heaters disposed around the reactor vessel. Internal heaters, however, become contaminated with reaction products and are difficult to clean. Cleaning is essential to prevent contamination of subsequent reactions with which the internal heater is reused. Integral jacket heaters significantly increase the cost of each individual reactor since they are not readily transferred for use with multiple reactor vessels.

To increase the versatility and cost effectiveness of a reactor heater, the heater has been configured as a separate furnace. A selected reactor vessel can then be inserted into the furnace for heating and removed therefrom after completing the heating cycle. Conventional furnaces typically have employed heater means located within the side walls of a furnace housing or enclosure. Ordinarily, the furnace enclosure walls and heater means have been spaced a discrete distance away from the vessel to provide a clearance that facilitates placement of the vessel into the furnace. Such a configuration, however, does not provide a maximized heat transfer rate from the heater means into the vessel. Furnaces have often taken over one hour to heat a vessel to about 500° C.

Conventional furnaces have generally lacked heater means for heating the bottom of the vessel. As a result, the heating of the vessel is non-uniform. The temperature difference between the middle region of the vessel and the bottom region of the vessel has been as much as 5–10 percent of the total temperature rise of the furnace above the ambient temperature. For example, for a 500° C. temperature rise in the furnace, a 50° C. temperature variation can exist between the bottom and middle regions of the vessel.

Conventional furnaces have also lacked a reliable temperature sensor device. Typically, a thermocouple has been connected against an outwardly facing surface of the inside wall of the furnace enclosure. Consequently, the thermocouple has been separated from the actual vessel by the wall thickness of the enclosure as well as the clearance gap which exists between the furnace wall and the vessel. As a result, there has been an inaccurate monitoring of the actual vessel temperature. In addition, the thermocouple can often become disconnected from the wall of the furnace thereby making the temperature monitoring even less accurate. Since the thermocouple is generally hidden internally, it cannot be seen to check its integrity. Therefore, temperature control in conventional furnaces has been poor and the actual temperature of the vessel can overshoot the desired temperature by as much as 100° C.

Thus, conventional furnaces for heating pressure vessels, such as those described above, do not provide as rapid a heating rate as is desirable. Such furnaces have produced non-uniform heating of the vessel volume, and have had unreliable and inaccurate temperature sensor systems.

SUMMARY OF THE INVENTION

The invention provides an apparatus and method for rapidly heating a vessel, such as a pressure vessel or reactor, and accurately monitoring the vessel temperature. Generally stated, the apparatus of the invention provides a furnace for heating a vessel having a vessel bottom and at least one vessel side wall. The furnace includes a furnace housing which is adapted to contain the vessel and which has a housing bottom and at least one housing side wall. A heating means is located at the housing bottom and at the housing side wall for heating the vessel, and is adapted to contact selected portions of the vessel bottom and the vessel side wall. Thermal insulating means are disposed about the housing for reducing the heat loss therefrom, and at least one extendable temperature sensing means is adapted to contact the vessel for monitoring the temperature thereof.

In accordance with the invention, there if further provided a method for heating a vessel which has a vessel bottom and at least one vessel side wall. Selected portions of the vessel bottom and the vessel side wall are heated by direct-contact thermal conduction within a furnace, and the furnace is insulated to reduce heat loss therefrom. After the heating of the vessel is completed, the vessel is removed from the furnace.

By contacting distributed portions of both the vessel bottom and the vessel side wall directly with the heating means, the invention maximizes heat conduction into the vessel. The configuration advantageously provides a very rapid heating rate with maximized energy efficiency. For example, a standard 300 mL pressure vessel can be heated to about 550° C. in about 15–20 minutes. Additionally, the heating rate throughout the volume of the vessel is substantially uniform. In particular, the heating rate at the vessel middle region and bottom region are approximately equal.

The extendable temperature sensing means of the invention directly contacts the vessel to provide improved sensor accuracy and temperature response speed. The contact between the temperature sensor and the vessel can be easily verified by the operator and the sensor is removable for ease of servicing. As a result of the improved sensor accuracy and response speed, temperature overshoot in the vessel can be limited to about 10°–15° C.

Thus, the invention provides a portable, energy efficient furnace for heating a removeable vessel, such as reactor vessels. The furnace is capable of rapidly heating the vessel and accurately monitoring the vessel temperature. Compared to conventional furnaces without heating means that heat the bottom of the vessel and without heating means that directly contact the vessel, the present invention provides more rapid and more uniform heating. Compared to conventional furnaces with fixed temperature sensors that do not actually contact the pressure vessel, the invention more accurately monitors the vessel temperature and allows more precise control of the furnace heater means.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

For the purposes of the present invention and as used in the specification and claims, a furnace is an apparatus in which a selected article, such as a vessel, is contained and heated. After a heating cycle is completed, the article is readily removed and separated from the furnace.

Figure 1:
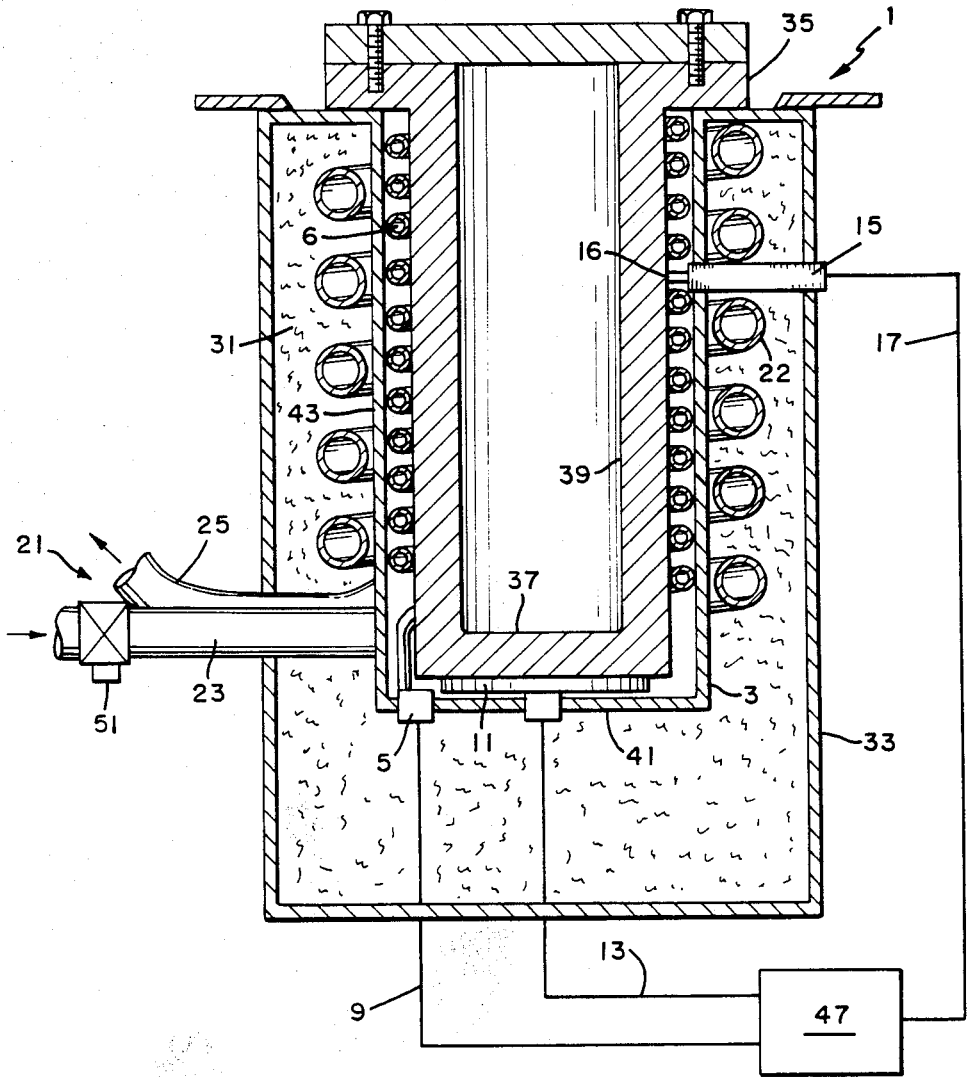
FIG. 1 shows a representative cross-sectional view of the furnace with a pressure vessel placed therein.

FIG. 1 shows a cross-sectional view of a representative vessel, such as a reactor pressure vessel 35, located within a furnace 1 of the invention for heating. Pressure vessel 35 has a vessel bottom 37 and at least one vessel side wall 39. The pressure vessel is typically cylindrical in shape and thus comprises a disk-shaped bottom 37 and a continuous, cylindrical side wall 39. The pressure vessel may come in standard sizes, such as 300 mL, 1 liter and larger sizes, and is constructed to withstand pressures of up to about 15,000 psi and more depending on the vessel design. Consequently, the vessel is constructed of high strength, corrosion resistant material, such stainless steel or Monel, and typically weighs about 20–60 lbs. for a 1-liter vessel.

Furnace 1 includes a furnace housing 3 which is adapted to contain vessel 35. Furnace housing 3 has a housing bottom 41 and at least one housing side wall 43. Heating means for heating vessel 35 is comprised of a bottom heater 11 located at the housing bottom and a side wall heater 5 located at the housing side wall. Bottom heater 11 and side wall heater 5 are adapted to contact selected areal portions of vessel bottom 37 and vessel side wall 39 and thereby provide direct-contact thermal conduction of heat into the vessel. Thermal insulating means 31 are disposed about housing 3 and the heating means to reduce heat loss therefrom, and an extendable temperature sensing means 15 is adapted to directly contact vessel 35 to monitor the vessel temperature.

In a preferred embodiment, the furnace further includes a temperature regulating means comprised of a temperature controller 47. The controller is operably connected to the heating means to regulate heater power in response to data received from the temperature sensing means and thereby regulate the temperature of the furnace. In addition, a cooling means comprised of a helically wound tubular coil 21 selectively cools furnace 1, and a coolant regulator means, such as solenoid valve 51, controls a flow of fluid coolant through the cooling means.

Figure 2:
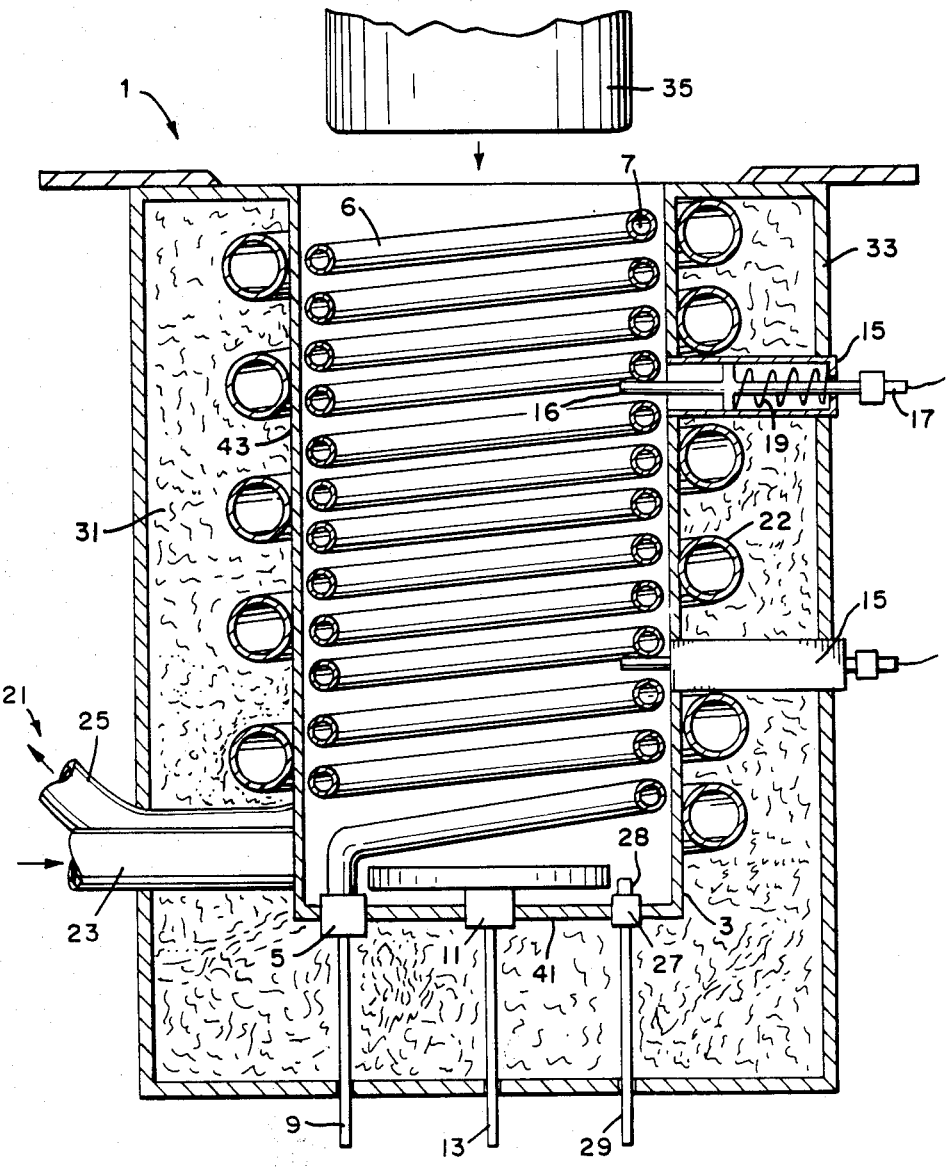
FIG. 2 shows a representative cross-sectional view of the furnace.
Figure 4:
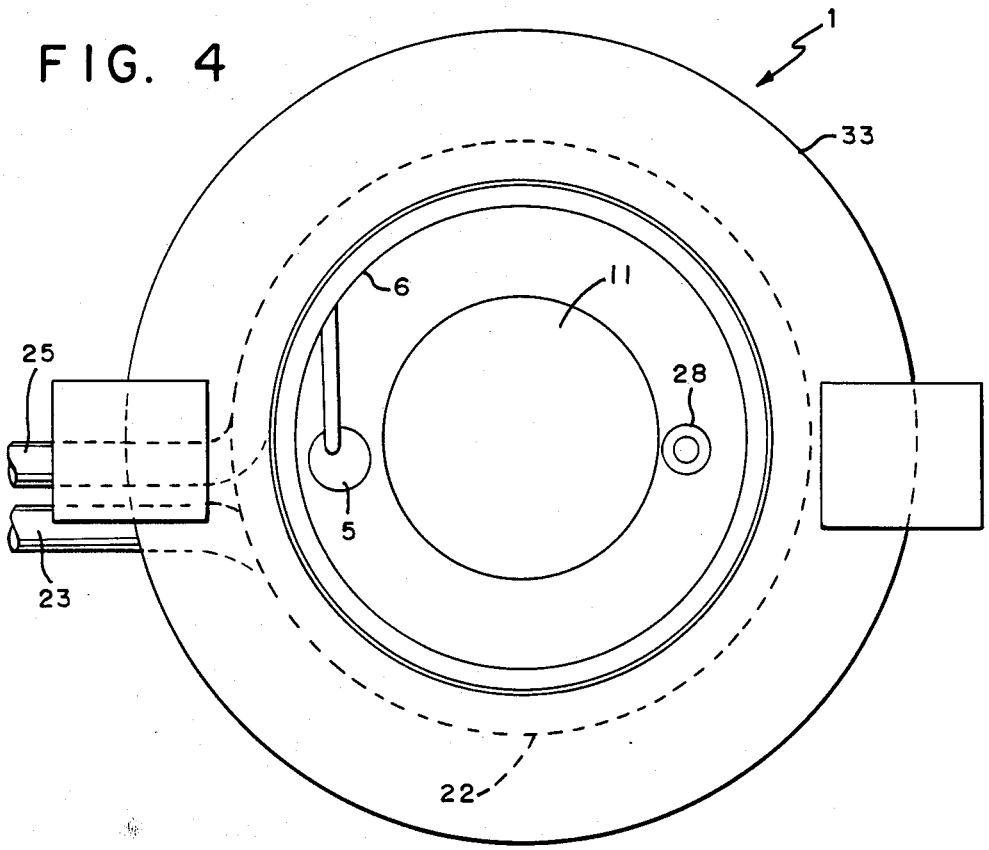
FIG. 4 shows a top plan view of the furnace.

FIG. 2 shows a representative cross-sectional view of furnace 1 in more detail. Housing 3 is composed of a temperature resistant, high strength material, such as stainless steel, and is configured to accommodate the particular size and shape of the selected vessel that is appointed for heating. Since pressure vessels are typically cylindrical in shape, housing 3 is preferably similarly configured to provide a circular disk housing bottom 41 and a substantially continuous, cylindrical side wall 43.

A heating means is comprised of bottom heater 11 and side wall heater 5. Various types of heaters, such as circulating hot fluid heaters are suitable, but electrical resistance heaters are preferred. Thus, bottom heater 11 is an electrical plate heater, and is adapted to contact selected, distributed portions of vessel bottom 37. An example of such a heater is a disk heater manufactured by Chromalox located in Murfreesboro, TN or manufactured by Edwin L. Wiegand Division of Emerson Electric Corp. located in Pittsburgh, PA. Power lead 13 connects the plate heater to a suitable source of electrical power.

Side wall heater 5 is preferably configured as a helical coil although other configurations, such as heater elements oriented along the longitudinal axis of housing 3 or heater elements oriented in a zig-zag pattern may also be used. Heater 5, as shown, is comprised of an electrical heater element 7 located inside a coiled metal tubing 6. Element 7 is electrically isolated from other parts of furnace 1 but suitably arranged to provide the desired heat transfer through tubing 6 into vessel 35. Heater 5 connects to a suitable source of electrical power through leads 9.

Side wall heater 5 is advantageously located along an inwardly facing surface of housing side wall 43 and is adapted to provide an interference type fit with vessel 35. For example, a resilient spring action of the coil tubing 6 is adapted to urge heater 5 toward vessel side wall 39 and provide a sliding interference fit that establishes the desired positive contact directly against selected, distributed portions thereof.

As illustrated by FIG. 1, bottom heater 11 and side wall heater 5 are adapted to contact vessel 35 across as much of the surface areas of vessel bottom 37 and vessel side wall 39 as is practicable. Maximizing the distributed areal portions of the vessel bottom and side walls in direct, thermally conductive contact with the heating means advantageously maximizes heat transfer into vessel 35. Heating both vessel bottom 37 and vessel side wall 39 substantially equalizes the heating rates throughout the volume of vessel 35, particularly in the bottom and middle regions thereof.

Thermal insulating means 31, such as heat resistant ceramic fiber insulation, is disposed about housing 3 and the heating means to reduce heat loss therefrom. A final outer enclosure 33 holds the insulation in place.

Referring again to FIG. 2, a high temperature cut-off 27 can be included to prevent possible damage to the furnace. Cut-off 27 is preferably comprised of a thermocouple 28 connected by leads 29 to a regulator that processes a signal from the thermocouple and controls the operation of heaters 11 and 5.

A bayonnet type temperature sensing means 15 is preferably comprised of a thermocouple 16 with a broad, flattened contact element having about 0.2 sq. cm. of contact area. At least one temperature sensor 15 is positioned through outer enclosure 33 and through housing side wall 43 into the furnace volume and adapted to directly contact vessel 35. Optionally, a plurality of temperature sensors can be employed. Preferably, thermocouple 16 is extendable and retractable to allow placement of vessel 35 into the furnace without interference from the temperature sensor. In addition, thermocouple 16 is preferably urged by forcing means, such as spring means 19, toward vessel 35 to provide positive contact with the vessel. Positive contact is readily verifiable by checking the extension of thermocouple 16. As representatively shown in FIG. 1, output leads 17 are operably connected to a suitable temperature regulating means 47 that regulates the heater means of the furnace in response to temperature sensing means 15.

By maintaining positive contact of thermocouple 16 against vessel 35, temperature sensing means 15 can accurately and quickly sense and monitor the temperature of vessel 35. This, in turn, allows a more precise and accurate control of the heating means to limit excessive temperature rise or temperature overshoot within vessel 35. Since thermocouple 16 is readily accessible from the side of housing 3, it can be easily removed and serviced.

To further assist in controlling the temperature of the furnace, cooling means 21 are preferably disposed along the outwardly facing surface of housing side wall 43 and adapted to selectively cool furnace 1, as shown in FIG. 2. Cooling means 21 is comprised of a helical coil of tubing 22, such as stainless steel tubing, and is adapted to accommodate a flow of fluid coolant therethrough. In association with cooling means 21, a coolant regulating means, such as a solenoid valve 51, controls the coolant flow from a coolant source 50 (FIG. 3) through cooling means 21. By appropriately configuring and selectively operating valve 51, the valve can be adapted to minimize temperature overshoot in vessel 35, and can also be used to rapidly cool down the furnace after a heating cycle is completed.

Figure 3:
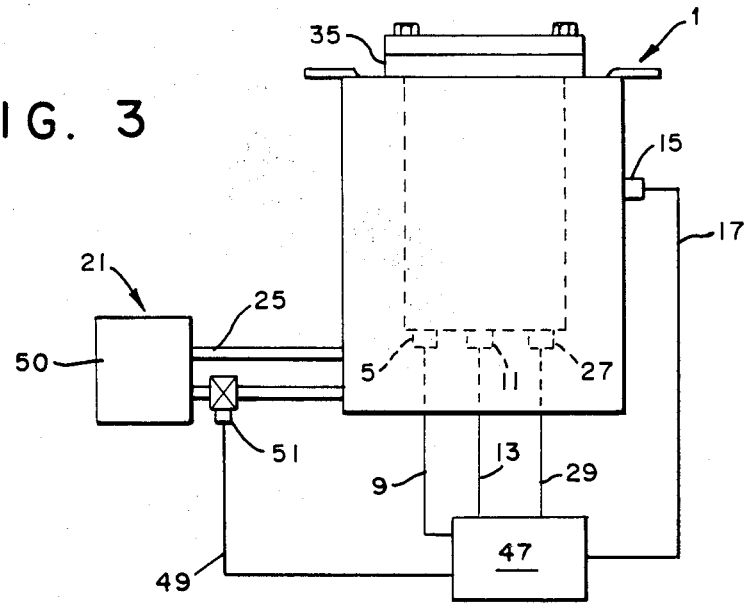
FIG. 3 shows a schematic representation of a control system for regulating the temperature of the furnace.

FIG. 3 shows a schematic representation of a preferred embodiment of the invention which incorporates a temperature controller 47 to automatically monitor the furnace temperature, control the furnace heating means and control the operation of valve 51. Such a temperature regulator provides automatic, rapid and accurate control of the temperature within vessel 35, and an example of a suitable regulator 47 would be a Love Controller-151 manufactured by Love Controls Corp. located in Wheeling, Ill.

Temperature sensor input signals are directed from temperature sensors 15 and high temperature cut-off 27 through signal leads 17 and 29, respectively, into temperature regulator 47. In accordance with a selected temperature set point, controller 47 selectively directs power to heaters 5 and 11 and selectively controls valve 51 to pass coolant through cooling means 21. As a result, the temperature of furnace 1 is automatically and accurately controlled, and temperature overshoot in vessel 35 is minimized.

During operation, spring loaded thermocouple 16 is retracted to prevent interference as vessel 35 is placed into furnace 1 and in direct, positive contact with heaters 5 and 11. Thermocouple 16 is then extended to establish positive contact with the vessel, and power is supplied to heaters 5 and 11 through leads 9 and 13, respectively. Thermocouple 16 monitors the resultant temperature rise of vessel 35 and provides a signal to temperature controller 47. At a selected first temperature setpoint, temperature controller 47 removes power from heaters 5 and 11 while thermocouple 16 continues to monitor the temperature of vessel 35. If the temperature rise in the vessel is excessive and the temperature overshoots a second temperature set point, temperature controller 47, in response to temperature data received from thermocouple 16, opens valve 51 to flow coolant through cooling tube 22 to minimize the temperature overshoot. To maintain a substantially constant temperature in the vessel, controller 47 selectively reapplies power to heaters 5 and 11. After the heating cycle is completed, a flow of coolant through tube 22 rapidly cools down the furnace and vessel 35 is removed therefrom.

Having thus described the invention in rather full detail, is will be understood that these details need not be strictly adhered to but that various changes and modifications may suggest themselves to one skilled in the art, all falling within the scope of the invention as defined by the subjoined claims.

I claim:

1. A furnace for heating a vessel having a vessel bottom and at least one vessel side wall, comprising:

(a) a furnace housing which is adapted to contain said vessel and has a housing bottom and at least one housing side wall;

(b) bottom heating means located at said housing bottom for contacting and heating said vessel bottom;

(c) side wall heating means located at said housing sidewall for contacting and heating said vessel sidewall said sidewall heating means constructed to provide a resilient, sliding interference fit directly against said vessel when the vessel is placed in said furnace;

(d) thermal insulating means disposed about said housing for reducing heat loss therefrom.

2. A furnace as recited in claim 1, further comprising temperature regulating means operably connected to said sidewall heating means and said bottom heating means for regulating said sidewall heating means and said bottom heating means in response to said temperature sensing means to regulate the temperature of said furnace.

3. A furnace as recited in claim 1, further comprising:

(a) cooling means disposed along said housing side wall for selectively cooling said furnace; and (b) coolant regulating means for controlling a flow of fluid coolant through said cooling means.

4. A furnace as recited in claim 3, wherein said coolant regulating means is adapted to minimize temperature overshoot of said vessel.

5. A furnace as recited in claim 1, wherein said sidewall heating means and said bottom heating means comprises:

(a) a plate-type electrical heater located at said housing bottom; and (b) an electrical resistance heater in the configuration of a helical coil located along an inwardly facing surface of said housing side wall.

6. A furnace as recited in claim 1, wherein said temperature sensing means is comprised of a bayonnet type thermocouple with a flat contact element.

7. A furnace as recited in claim 1, further comprising forcing means for urging said temperature sensor means toward said vessel to provide positive contact therewith.

8. A furnace as recited in claim 7, wherein said temperature sensing means is urged toward said vessel by spring means.

9. A furnace as recited in claim 1, further comprising at least one extendable temperature sensing means adapted to contact said vessel for monitoring the temperature thereof.

10. A furnace as recited in claim 1, wherein said sidewall heating means has the configuration of a helical coil, the resilient spring action of which urges said coil into contact directly against said vessel to provide said heating and sliding interference fit.

11. A furnace for heating a vessel having a vessel bottom and at least one vessel sidewall, comprising:

(a) a furnace housing which is adapted to contain said vessel and has a housing bottom and at least one housing sidewall;

(b) bottom heating means located at said housing bottom for contacting and heating said vessel bottom;

(c) sidewall heating means located at said housing sidewall for contacting and heating said vessel sidewall, said sidewall heating means constructed to provide a resilient, sliding interference fit directly against said vessel when the vessel is placed in said furnace;

(d) thermal insulating means disposed about said housing for reducing heat loss therefrom;

(e) at least one extendable temperature sensing means comprised of a bayonnet type thermocouple which is adapted to contact said vessel for monitoring the temperature thereof;

(f) forcing means for urging said thermocouple toward said vessel to maintain positive contact therewith;

(g) cooling means disposed along said housing sidewall for selectively cooling said furnace;

(h) coolant regulating means comprised of a solenoid valve for controlling a flow of fluid coolant through said cooling means; and (i) temperature regulating means for controlling said heating means and said coolant regulating means in response to said temperature sensing means to minimize temperature overshoot in said vessel.

12. A furnace as recited in claim 11, wherein said sidewall heating means has the configuration of a helical coil, the resilient spring action of which urges said coil into contact directly against said vessel to provide said heating and sliding interference fit.

* * * * *